US008707703B2

(12) United States Patent
Kim

(10) Patent No.: US 8,707,703 B2
(45) Date of Patent: Apr. 29, 2014

(54) DUAL SWIRLER

(75) Inventor: Ik Soo Kim, Glasgow (GB)

(73) Assignee: Siemens Aktiengesellschaft, Munich (DE)

( * ) Notice: Subject to any disclaimer, the term of this patent is extended or adjusted under 35 U.S.C. 154(b) by 1193 days.

(21) Appl. No.: 12/622,685

(22) Filed: Nov. 20, 2009

(65) Prior Publication Data

US 2010/0126176 A1 May 27, 2010

(30) Foreign Application Priority Data

Nov. 26, 2008 (EP) ..... 08020578

(51) Int. Cl.
*F02C 7/057* (2006.01)

(52) U.S. Cl.
USPC ..... 60/748; 60/39.23

(58) Field of Classification Search
USPC ..... 60/733, 737, 746, 747, 748, 39.23
See application file for complete search history.

(56) References Cited

U.S. PATENT DOCUMENTS

| | | | | |
|---|---|---|---|---|
| 5,319,935 | A | 6/1994 | Toon et al. | |
| 5,361,586 | A * | 11/1994 | McWhirter et al. | 60/737 |
| 6,253,555 | B1 | 7/2001 | Willis | |
| 8,196,411 | B2 * | 6/2012 | Wilbraham | 60/748 |

FOREIGN PATENT DOCUMENTS

| | | | |
|---|---|---|---|
| DE | 20018375 | U1 | 5/2001 |
| EP | 0957311 | A2 | 11/1999 |
| GB | 2272756 | A | 5/1994 |
| GB | 2437977 | A | 11/2007 |
| WO | WO 99/19674 | A1 | 4/1999 |
| WO | WO 2007/060216 | | 5/2007 |

* cited by examiner

*Primary Examiner* — Phutthiwat Wongwian
*Assistant Examiner* — Vikansha Dwivedi

(57) ABSTRACT

A swirler arrangement for injecting a fluid into a tubular swirling chamber is provided. The swirler arrangement includes a first radial swirler device and a second radial swirler device. The swirler arrangement is fixed around an internal circulation zone of the tubular swirling chamber. The first radial swirler device includes first vanes, wherein the first vanes are formed to inject the fluid into the internal circulation zone with a first injecting angle. The second radial swirler device includes second vanes, wherein the second vanes are formed to inject the fluid into the internal circulation zone with a second injecting angle. The first injecting angle and the second injecting angle are defined by an angle between an injecting direction of the fluid and the tangential direction along the inner surface. A method of injecting a fluid into a tubular swirling chamber by the swirler arrangement is also provided.

15 Claims, 10 Drawing Sheets

DUAL SWIRLER

CROSS REFERENCE TO RELATED APPLICATIONS

This application claims priority of European Patent Office application No. 08020578.4 EP filed Nov. 26, 2008, which is incorporated by reference herein in its entirety.

FIELD OF THE INVENTION

The present invention relates to a swirler arrangement for injecting a fluid into a tubular swirling chamber. Moreover, the present invention relates to a method of injecting a fluid into a tubular swirling chamber.

ART BACKGROUND

In order to provide a homogeneous air/fuel mixture for a combustion chamber of gas turbines, an air/fuel mixture may be injected into a tubular swirling chamber of the turbine. When injecting a fluid, such as air, fuel or an air/fuel mixture, radially, a defined swirling of the air/fuel mixture in the tubular swirling chamber is generated. By such a defined swirling of the fluid, a proper mixing ratio of the air/fuel mixture and a stable flame on a pilot body surface in the tubular swirling chamber may be provided.

For injecting fluid radially, radial swirlers are attached to a pre-chamber of the tubular swirling chamber in order to generate a strong turbulence flow of the fluid in the pre-chamber. In conventional radial swirlers, the fluid is in general injected tangentially to an inner surface of the pre-chamber, so that a high tangential moment inside the pre-chamber and a vortex of the fluid inside the pre-chamber and a combustion chamber of the tubular swirling chamber may be generated. The vortex provides a turbulent swirling region in the vicinity of the inner lateral area and a slow, inturbulent flow in the core of the vortex.

The fluid flow inside the pre-chamber and the combustion chamber will be described in the following in more detail. Usually, the pre-chamber and the combustion chamber are formed tubular, wherein the diameter of the pre-chamber is smaller than the diameter of the combustion chamber. When the injected fluid flows from the pre-chamber to the combustion chamber of the tubular swirling chamber, the diameter and thus the available volume increases abruptly. Thus, an axial pressure drop occurs. Under the influence of the axial pressure drop, that is generated by the change in a diameter difference of the pre-chamber and the combustion chamber, the fluid flows in a longitudinal direction from the pre-chamber to the combustion chamber. In the region where the axial pressure drop occurs, the fluid expands abruptly which causes the fluid to turn from the lateral area inwards towards the centre axis of the pre-chamber and/or the combustion chamber. Then, the fluid flows in the vicinity of the centre axis in an axial counter-direction towards the swirler and towards a base area (pilot body surface) of the pre-chamber again. The region of the counter-direction flow may be called internal re-circulation zone. The internal re-circulation zone is located along the centre axis of the combustion chamber inside of the vortex. At the base area (pilot body surface) the air/fuel mixture may be ignited and forms a flame. Next, the ignited air/fuel mixture turns outwards in the direction to the lateral surface of the pre-chamber and meets the incoming fluid injected by the swirler. At the location, where the internal re-circulating flow meets the incoming flow from the swirler passages, a region of turbulence is generated. Between this region and the centre region a shear layer is formed, wherein an ignited air/fuel mixture on the one side of the shear layer and the injected fluid from the swirler on the other side of the shear layer flows again in the axial direction of the pre-chamber and the main chamber. In this manner a so-called "internal recirculation vortex core flow" inside the pre-chamber and the combustion chamber is generated. Hence, the benefit may be that in the vicinity of the pilot body surface (ignition area of the air/fuel mixture) a proper mixing ration of the air/fuel mixture, a slower velocity of the air/fuel mixture and thus a larger exposure time in the area of ignition may be provided, so that a more effective combustion may be achieved.

EP 0 957 311 A2 discloses a gas-turbine engine combustion. A lean burn combustor of a gas-turbine engine comprises a radial inflow pre-mixing and a pre-swirling burner with a central burner phase that forms an upstream wall of a pre-chamber of the combustor. A circular recess is formed in the burner phase, wherein the recess comprises at least one pilot fuel injector for introducing pilot fuel tangentially into the recess.

WO 2007/060216 A1 discloses a combustion apparatus in which combustion of a fuel/oxidant mix takes place. A pre-chamber is located to the combustion chamber and swirlers for supplying a gas to the pre-chamber are provided, so as to form a film of gas on the interior surface of the pre-chamber and thus prevent a combustion flame from the combustion chamber attaching itself to this interior surface damaging the pre-chamber. The film is provided by setting back a wedged piece of a swirler from a radially inner edge of an annular plate, so that an annular ledge on the annular base plate may be provided.

U.S. Pat. No. 6,253,555 B1 and U.S. Pat. No. 5,319,935 disclose a combustion chamber comprising mixing ducts with fuel injectors varying in number and cross-sectional area. First and second swirlers are arranged such that a fuel to air ratio of the fuel and air is swirled in opposite direction.

SUMMARY OF THE INVENTION

It may be an object of the present invention to provide a proper fuel injection system for a turbine.

In order to achieve the object defined above, a swirler arrangement for injecting a fluid into a tubular swirling chamber and a method of injecting a fluid into a tubular swirling chamber according to the independent claims are provided.

According to a first exemplary embodiment of the present invention, a swirler arrangement for injecting a fluid into a tubular swirling chamber is provided. The swirler arrangement comprises a first radial swirler device and a second radial swirler device. The swirler arrangement is adapted for being fixed around an internal circulation zone of the tubular swirling chamber. The first radial swirler device comprises first vanes, wherein the first vanes are formed to inject the fluid into the internal circulation zone with a first injecting angle. The second radial swirler device comprises second vanes, wherein the second vanes are formed to inject the fluid into the internal circulation zone with a second injection angle. The first injecting angle and the second injecting angle are defined by an angle between an injecting direction of the fluid and a tangential direction along the inner surface. The first injecting angle and the second injecting angle are smaller than 90° (degree), wherein the first injecting angle and the second injecting angle are different.

According to a further exemplary embodiment, a method of injecting a fluid into a tubular swirling chamber by a swirler arrangement is provided. The swirler arrangement thereby is adapted for being fixed around an internal circulation zone of the tubular swirling chamber. The fluid is injected into the internal circulation zone with a first injecting angle by first vanes of a first radial swirler device of the swirler arrangement. The fluid is furthermore injected into the internal circulation zone with a second injecting angle by second vanes of a second radial swirler device of the swirler arrangement. The first injecting angle and the second injecting angle are defined by an angle between an injecting direction of the fluid and a tangential direction along the inner surface. The first injecting angle and the second injecting angle are smaller than 90° (degree), wherein the first injecting angle and the second injecting angle are different.

The tubular swirling chamber may comprise a combustion chamber and a pre-chamber. The pre-chamber and the combustion chamber may be formed tubular, wherein the pre-chamber and the combustion chamber may provide a common centre axis. The combustion chamber may provide a larger diameter than the pre-chamber. In the tubular swirling chamber, the internal circulation zone of the fluid may be provided, i.e. inside of the tubular swirling chamber, a predetermined circulation of the fluid may be provided wherein the fluid moves downstream in the tubular swirling chamber. The pre-chamber may comprise a closed end wherein at the closed end a pilot body surface is provided. At the pilot body surface the fluid may be ignited, so that a flame that burns in the tubular swirling chamber may be anchored to the pilot body surface. The region of the pilot body surface to which the flame is anchored may be called flame anchor surface. At the opposite open end of the pre-chamber, the combustion chamber is attached that may comprise a larger diameter than the pre-chamber. By the change of the diameter the above described pressure drop may be provided for generating the axial movement of the injected fluid.

The swirler arrangement may be attached to the tubular swirling chamber for injecting radially the fluid. In particular, the swirler arrangement may be attached to the pre-chamber for injecting the fluid radially, so that a vortex around the centre axis of the swirling chamber may be generated. This vortex around the centre axis may move downstream in the direction to the open end of the pre-chamber due to the pressure drop caused by the change in diameter.

The first radial swirler devices and the second radial swirler devices may comprise first vanes and second vanes, wherein the first vanes and second vanes are circumferentially attached to the first radial swirler device and the second radial swirler device. Between each of the first vanes first ducts may be provided. Between each of the second vanes second ducts may be provided. The first ducts and second ducts guide the fluid from the outside of the tubular swirling chamber to the inside of the tubular swirling chamber. The first ducts are adapted for defining a first injection direction of the fluid into the tubular swirling chamber. The second ducts are adapted for defining a second injection direction of the fluid into the tubular swirling chamber. The first radial swirler device and the second radial swirler device are designed for injecting the fluid in such a way, that a vortex of the fluid when injecting into the tubular swirling chamber may be generated. The first radial swirler device and the second radial swirler device respectively the first vanes and the second vanes may be attached to a circular plate with an inner through-hole by which the plate may be attached to the tubular swirling chamber, i.e. the through-hole may comprise the diameter of the tubular swirling chamber.

The direction of the injection of the fluid when entering the tubular swirling chamber is defined by the first injection angle and the second injection angle. The first injection angle and the second injection angle are defined by an angle between the direction of the fluid at the location when entering the inside of the tubular swirling chamber and the tangential direction of the inner surface of the tubular swirling chamber at the location where the fluid exits the radial swirler arrangement inside of the tubular swirling chamber. With other words, if the fluid exits the ducts formed by the vanes into the inside of the tubular swirling chamber, the injection angle may define the angle between the exhaust direction of the fluid and the tangential direction along the inner surface. I.e. if the fluid would be injected in a tangential direction by the first radial swirler device, the first injecting angle between the flow direction of the fluid and the inner surface of the tubular swirling chamber would be 0° (degree) and if the fluid would be injected radially, so that the fluid flow direction would point to the centre axis of the tubular swirling chamber, the first injecting angle would provide a first injection angle of 90° (degree). The same definition is valid for the second radial swirler device and the second injection angle.

The term "fluid" may describe air, fuel or an air/fuel mixture of both. The fuel may be in a gaseous state or in a liquid state. The fuel may comprise kerosene or other combustible hydrocarbon materials in a liquid or gaseous state.

In conventional combustion chambers swirler devices are used for generating a strong turbulent flow, such as a vortex, of the injected fluid in order to improve the mixing ratio of the air/fluid mixture and to improve the flame stability in the tubular swirling chamber. In conventional radial swirlers the fluid is injected tangentially with respect to the inner surface of the tubular swirling chamber in order to generate a very high tangential moment inside of the combustion chamber in order to generate a vortex inside the combustion chamber. The tangential flow of the injected fluid generates a vortex with a large inner diameter, because due to the high tangential moment the fluid is flowing in the area of the inner surface of the tubular swirling chamber. In the centre area of the vortex of the fluid a flame anchor surface on the pilot body surface may be generated. Due to the high tangential moment generated by the tangential inflow of the fluid the flame anchor surface is very large. If the fluid would be injected by one swirling device more in the direction to the centre axis of the tubular swirling chamber, the vortex would provide a smaller diameter and thus a smaller flame anchor surface, but the flame would be instable.

By generating a vortex of the fluid inside the combustion chamber, the fluid vortex extends first of all along an axial direction away from the pilot body surface. By increasing the diameter of the combustion chamber, an axial pressure drop may be provided, so that a recirculation zone of the fluid may be generated. The internal recirculation zone is located along the centre axis of the combustion chamber, so that along the centre axis the fluid flows back to the direction of the pilot body surface. Thus, when the re-circulating fluid flows back in the vicinity of the pilot body surface, the ignition of the fluid occurs. I.e., by changing the injecting angle with one swirler device either the flame anchor surface may be reduced or the flame stability may be improved. A change of the injecting angel may cause other negative effects such as lower swirl numbers, poor air/fuel mixing relations, negative fluid dynamics, high emissions etc.

By using the swirling arrangement, i.e. a first radial swirler device and a second radial swirler device according to the claimed solution of the present invention, the fluid may be injected by a first radial swirler device and a second radial swirler device, each providing a different injecting angle, namely the first injecting angle and the second injecting angle. Thus, by providing different first injecting angles and second injecting angles of the fluid, the inflow of the fluid may be controlled in such a way, that the positive effects of a more tangential inflow (e.g. good vortex characteristics, improved flame stability, improved air/fuel mixing ratio) and similarly the positive effects of a more radial inflow (reduced flame anchor surface) may be achieved. I.e., good fluid dynamics and good compression characteristics of the injected fluid may be provided by similarly reducing the flame anchor surface on the pilot body surface. Any fluid guiding elements inside of the tubular swirling chamber that guide the injected fluid in a predetermined flow direction, e.g. along the axial direction, may be not necessary.

With other words, by providing a first radial swirler device and a second radial swirler device with different injecting angles, the diameter of the internal recirculation zone, in particular the diameter of the flame anchor surface, may be reduced e.g. by 50% without reducing the flame stability. Moreover, a flame anchor surface may be reduced without losing a homogeneous fuel/air mixing or without losing flame stability. A smaller flame anchor surface may extend the life cycle of the overall pilot body surface. Furthermore, when the flame anchor surface is smaller, more mixing volume or a larger mixing area for the injected fluid injected by the swirler devices may be provided. Thus, a more homogenous mixture of the injected fluid may be provided, i.e. the air/fuel mixing ratio may be improved.

According to a further exemplary embodiment, a first radial swirler device is located closer to the pilot body surface (e.g. closed end of the pre-chamber) of a tubular swirling chamber than the second radial swirler device. Furthermore, the second injecting angle is smaller than the first injecting angle. When the fluid is injected into the combustion chamber, the fluid flow generates the vortex that flows along a flow direction around the centre axis of the tubular combustion chamber and moves e.g. in a helix like shape along the centre axis. The first radial swirler device is located upstream, i.e. close to the pilot body surface and the second radial swirler device is located more downstream, in particular farer away from the pilot body surface. The streaming direction may be defined as a movement of the fluid along the centre axis starting from the pilot body surface of the pre-chamber in the direction to the combustion chamber. The pilot body surface closes the tubular combustion chamber on one closed end. At the pilot body surface the ignition of the fluid may be provided in a flame anchor surface of the pilot body surface. Furthermore, the pilot body surface may comprise fuel injection devices, such as fuel injection nozzles.

When the first injection angle of the first radial swirler device is larger (injection direction more radial to the centre axis) than the second injection angle (more tangential to the inner surface of the tubular swirling chamber), the fluid flow injected by the first radial swirler device is directed more to the centre of the combustion chamber. Thus, the vortex of the fluid in the internal circulation zone is generated by the more tangential second injection angle, wherein the vortex core is kept smaller by an injection of fluid with the first injecting angle. Thus, a vortex with high swirl numbers is generated by simultaneously keeping the vortex core and thus the flame anchor surface small.

As mentioned above, inside of the vortex core the flame anchor surface on the pilot body surface may be provided. Typically, when the fluid injection is not orientated tangentially, the swirl numbers of the vortex are reduced. By the present exemplary embodiment the second injecting angle is provided smaller than the first injecting angle, which means that the second fluid injected by the second radial swirler device is injected in a more tangential direction with respect to first injected fluid, injected by the first radial swirler device. Thus, the fluid injected by the second radial swirler device with the second injecting angle provides a more tangentially injected direction that forms a strong vortex inside the tubular swirling chamber with a high swirl number and a movement parallel to the centre axis of the combustion chamber (such as a helix shape). Thus, also a proper re-circulating flow in the re-circulating zone in the direction to the pilot body surface may be provided. At the same time, the more radial directed fluid, injected with the first injection angle, provides a smaller flame anchor surface reducing the flame stability.

According to a further exemplary embodiment, the swirler arrangement further comprises an adapter plate. The first radial swirler device and the second radial swirler device are attached to the adapter plate. The adapter plate may be formed by a circumferential plate with a through-hole, wherein the through-hole is adapted to the diameter of the tubular combustion chamber. On the side directed to the pilot body surface, the first vanes may be attached circumferentially in order to form the first radial swirler device. On the other adapter plate side, the second vanes may be attached in order to form the second radial swirler device. Thus, the first radial swirler device and the second radial swirler device may provide the same base plate, so that the overall weight may be reduced.

According to a further exemplary embodiment, the adapter plate comprises a defined thickness for spacing the first radial swirler device and the second radial swirler device apart. Thus, when increasing the thickness of the adapter plate, the location of injection of the fluid of the first radial swirler and/or the second radial swirler may be adjusted along the centre axis of the tubular swirling chamber. Thus, a desired predetermined and pre-calculated flow pattern of the fluid flow inside the tubular swirling chamber may be adjusted.

According to a further exemplary embodiment, at least one of the first radial swirler device and the second swirler device comprise injection holes. The first ducts formed by the first vanes and the second ducts formed by the second vanes may comprise injection holes for injecting fluid inside the ducts. The pressured air guided through the first ducts and the second ducts may be pre-mixed with the injected fuel. When the air/fuel mixture exits into the tubular swirling chamber, the air/fuel mixture may not be completely homogeneous but will be further improved in the tubular swirling chamber.

According to a further exemplary embodiment, at least one of the first vanes and the second vanes are movable, so that at least a desired first injection angle and/or second injection angle are adjustable. Thus, each of the first vanes and/or the second vanes may be movably supported, e.g. pivotable, so that the first injection angle and/or the second injection angle may be adjustable to a desired value. Thus, desired flow patterns of the fluid inside the tubular swirling chamber, e.g. adjusted to a variety of different operating states, may be generated. Thus, the degree of efficiency may be improved. Such adjustments may be performed during operation or during a configuration phase or test of the turbine.

According to a further exemplary embodiment, the swirler arrangement further comprises a control unit. The control unit is adapted for controlling the first injection angle and/or the second injection angle by moving the first vanes and/or the second vanes. The control unit may receive manual control signals for adjusting the first vanes and second vanes manually. Moreover, the control unit may be connected to a variety of sensors located into the tubular swirling chamber, so that the control unit may control the first vanes and the second vanes due to certain sensor values sensed by the sensors. Thus, the first vanes and the second vanes may be moved automatically in order to provide a certain desired flow pattern inside the combustion chamber.

According to a further exemplary embodiment, a first width of the first vanes and a second width of the second vanes are different. With width of vanes, mainly the dimension of the ducts perpendicular to the flow direction of the fluid through the duct is meant. Thus, the flow rate of the fluid mass flow through the first radial swirler device and the flow rate of the fluid mass flow through the second radial swirler device may be different. Thus, a defined mass flow through the first radial swirler device and through the second radial swirler device may be adjusted, so that a desired flow pattern inside the tubular swirling device may be achieved.

According to a further exemplary embodiment, a first height of the first vanes and a second height of the second vanes are different. With height, the dimension of the vanes in axial direction of the combustor is meant. Thus, a desired flow rate (mass flow) of the fluid that flows through the first radial swirler device and/or the second radial swirler device may be adjusted by the height of the vanes. Thus, a certain predetermined flow pattern inside the tubular swirling chamber may be provided.

According to a further exemplary embodiment, a plurality of first radial swirler devices and/or of second radial swirler devices may be provided. Thus, for instance a stack of first radial swirler devices and/or a stack of second radial swirler devices may be provided. For instance, a first radial swirler device may be located in the vicinity of the pilot body surface, wherein a stack of 3, 4 or 5 first or second radial swirler devices may be provided in an axial direction of the centre axis of the combustion chamber. Thus, a desired predetermined flow pattern inside the tubular swirling chamber may be adjusted.

Furthermore, the pilot body surface may be coated with a thermal barrier coating (TBC) in order to resist the heat of the flame ignited on the flame anchor surface.

By the present invention a first radial swirler device and a second radial swirler device is provided, so that a flow pattern of the injected fluid, in particular with an internal circulation zone and with a re-circulation zone, may be provided. By providing such a flow pattern, the flame anchor surface on the pilot body surface may be reduced without losing flame stabilization.

The first radial swirler device comprises a first injection angle with which injected fluid is directed more to the centre axis of the tubular swirling chamber than the second radial swirler device. Thus, the first radial swirler device may "push" the internal re-circulation zone in the swirling chamber towards the centre axis of the pilot surface. Thereby a mushroom like shape flow pattern may be formed, the trunk of the mushroom like shape being near the pilot surface and the head of the mushroom like shape being downstream in the direction of the main combustion chamber. The second radial swirler device injects the fluid with a second injecting angle that is directed more tangentially with respect to the inner surface of the combustion chamber. Thus, the second radial swirler device provides a fluid with a higher swirl number. The interface between the fluid vortex injected by the first radial swirler device and the fluid vortex injected by the second radial swirler device provides high shear force to generate a good air/fuel mixing.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
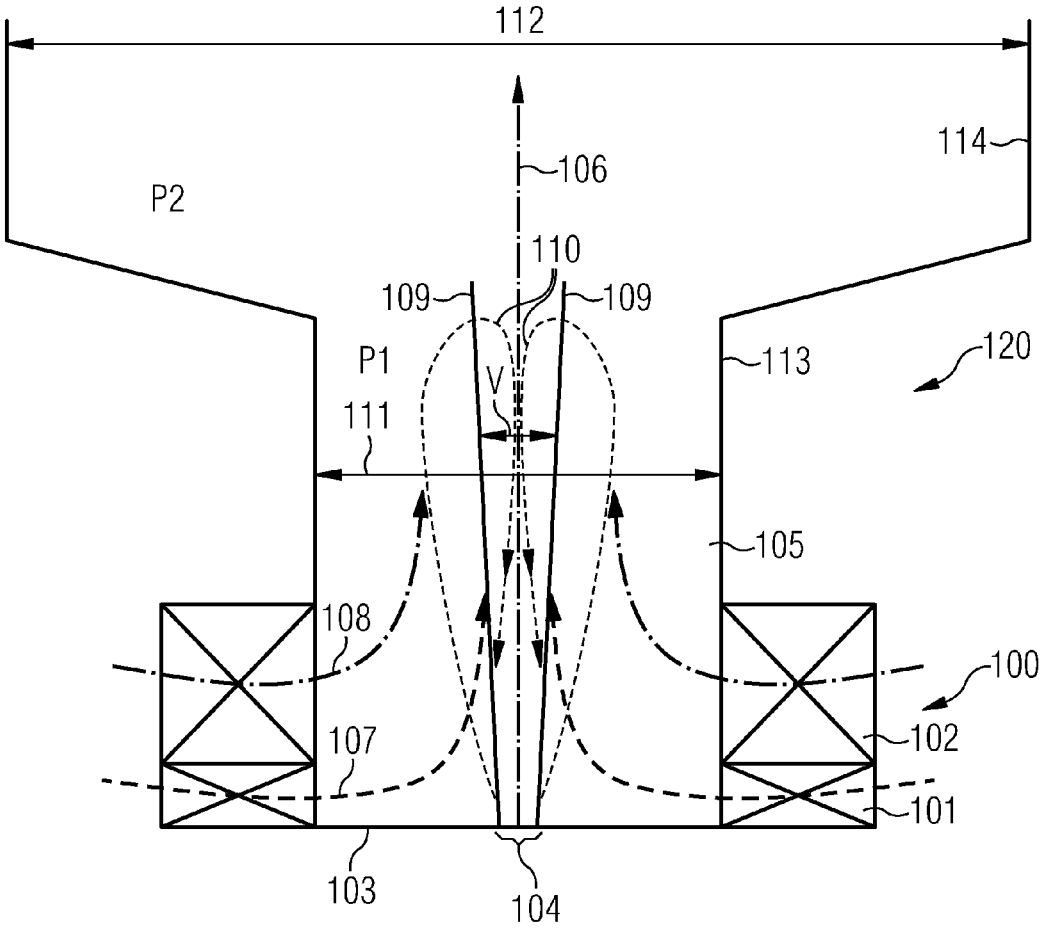
FIG. 1 shows a schematic view of a tubular swirling chamber with a swirler arrangement according to an exemplary embodiment of the invention.

The illustration in the drawing is schematically. It is noted that in different figures, similar or identical elements are provided with the same reference signs or with reference signs, which are different from the corresponding reference signs only within the first digit.

Figure 2B:
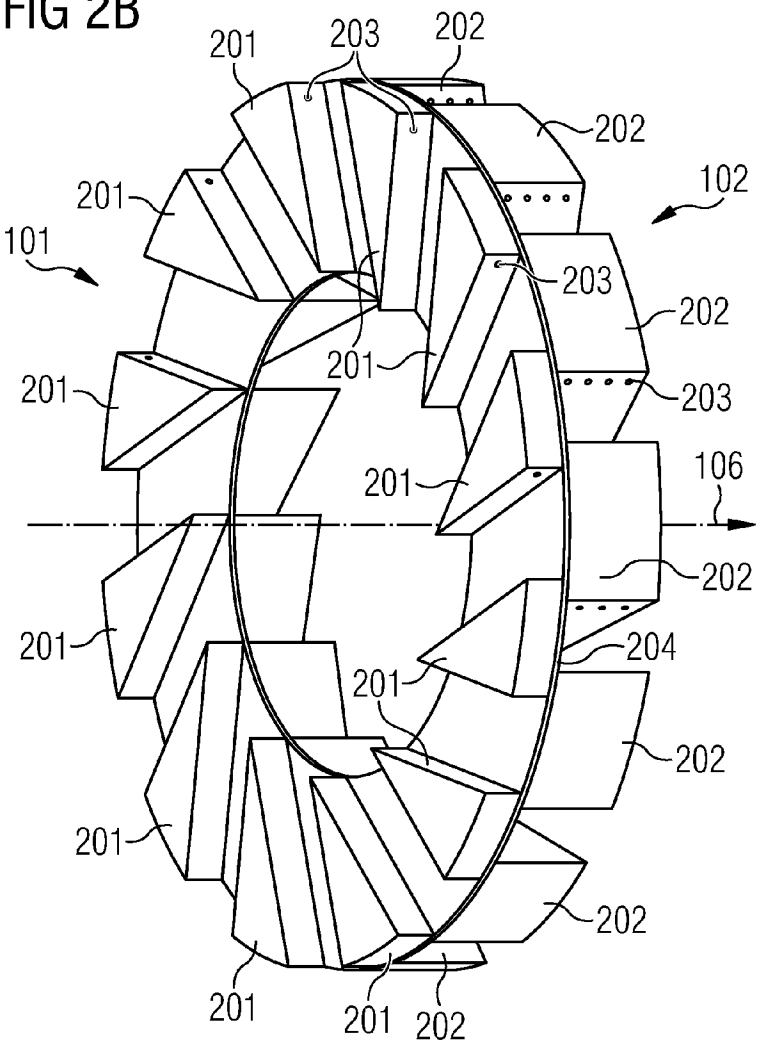
FIG. 2A and FIG. 2B show schematic illustrations of a perspective view of a first radial swirler device and a second radial swirler device according to an exemplary embodiment of the invention.
Figure 2A:
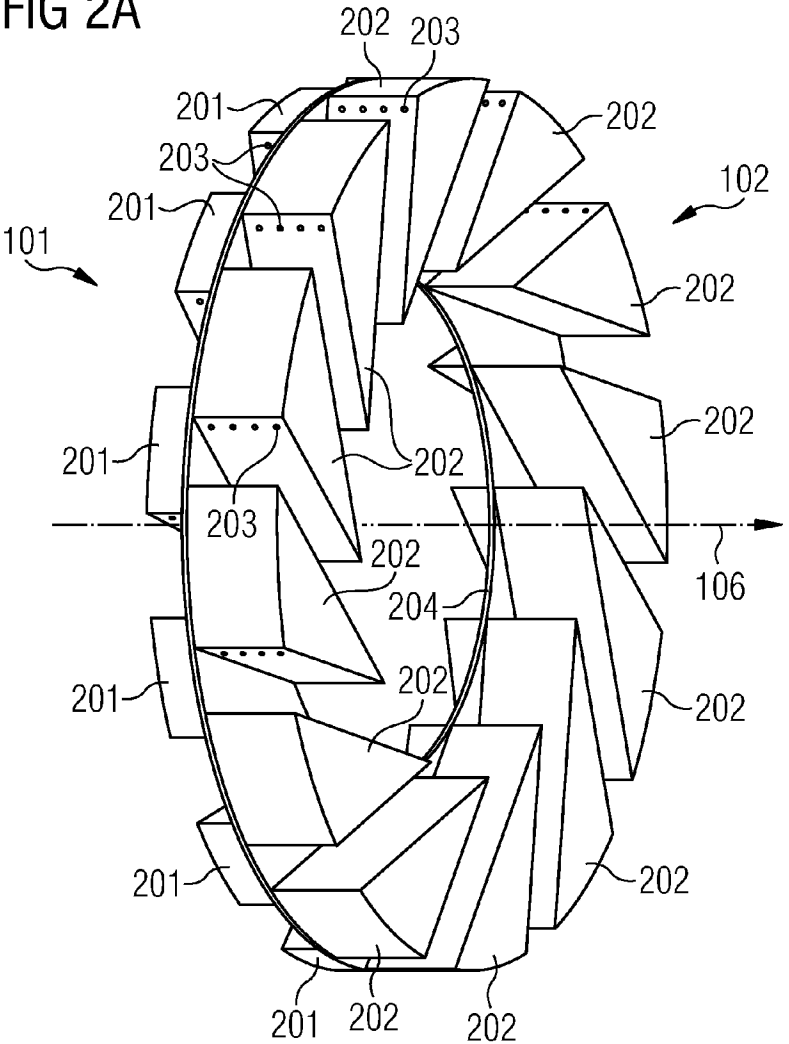
Figure 3:
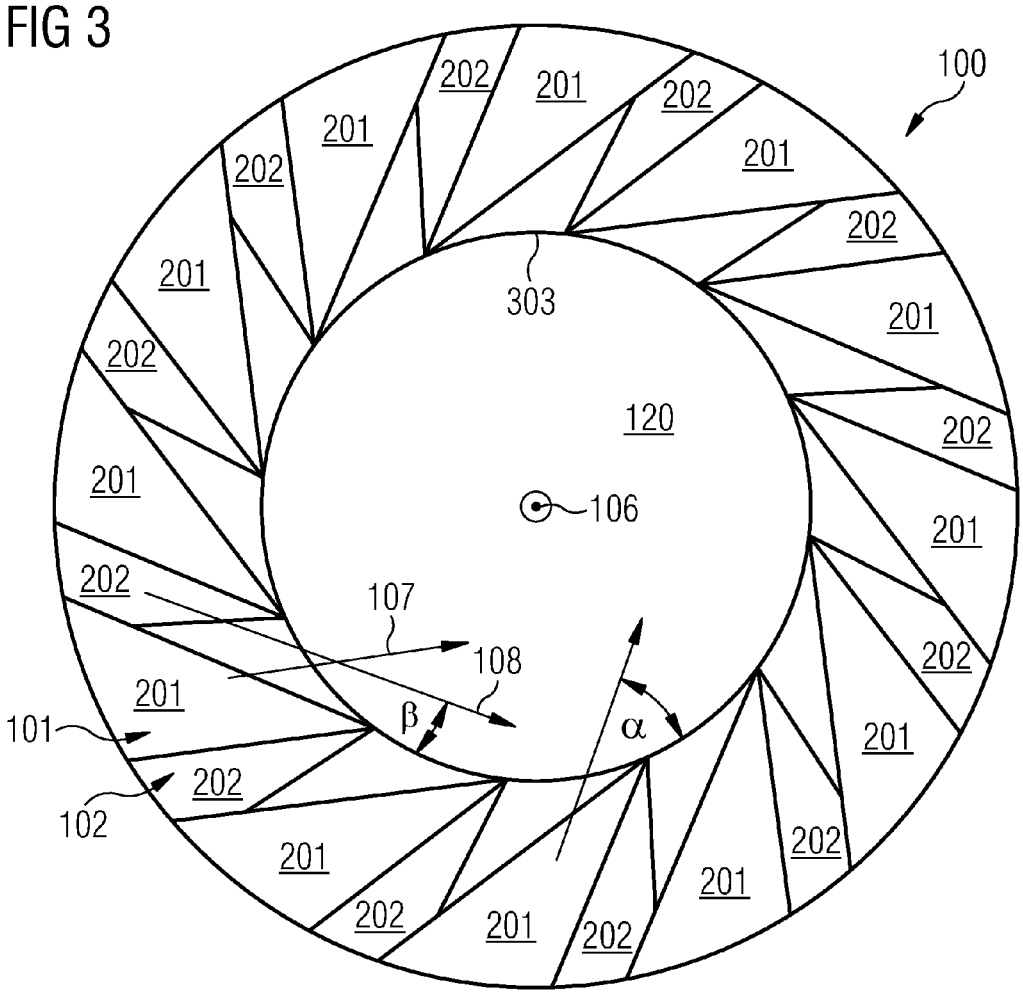
FIG. 3 shows a top view of a first and second radial swirler device in which the streaming direction of a fluid is indicated according to an exemplary embodiment of the invention.

FIG. 1 shows a swirler arrangement 100 for injecting a fluid into a tubular swirling chamber 120. The swirler arrangement 100 comprises a first radial swirler device 101 and a second radial swirler device 102, the second radial swirler device 102 being axially downstream of the first radial swirler device 101. The swirler arrangement 100 is adapted for being fixed around an internal circulation zone 105 of the tubular swirling chamber 120. The first radial swirler device 101 comprises first vanes 201 (as illustrated in FIGS. 2 and 3), wherein the first vanes are formed to radially inject the fluid into the internal circulation zone 105 with a first injecting angle $\alpha$ (as illustrated in FIG. 3). The second radial swirler device 102 comprises second vanes 202 (as illustrated in FIGS. 2 and 3), wherein the second vanes 202 are formed to radially inject the fluid into the internal circulation zone 105 with a second injecting angle β (as illustrated in FIG. 3). The first injecting angle α and the second injecting angle β are different. The first and second injecting angle α, β are shown in more detail in FIG. 3 and the first vanes 201 and the second vanes 202 in FIG. 2A and FIG. 2B.

Moreover, FIG. 1 illustrates the tubular swirling chamber 120 to which the first radial swirler device 101 and the second radial swirler device 102 may be attached. A fluid or gas, such as air or an air/fuel mixture, may stream under pressure inside the tubular swirling chamber 120. The tubular swirling chamber 120 may comprise a pre-chamber 113 and a combustion chamber 114. The pre-chamber 113 comprises a first diameter 111 and the combustion chamber 114 comprises a second diameter 112. The fluid may be injected with a second injecting angle β (illustrated in FIG. 3) in a more tangential direction into the pre-chamber 113, so that a vortex of the fluid flow 106 is generated. Thus, the fluid flows in a second flow direction 108 in the direction to the combustion chamber 114 with a first fluid pressure P1. The first radial swirler device 101 directs the fluid in a more radial direction to the region of the centre axis 106 of the pre-chamber 113 in a first flow direction 107. The fluid injected by the first injecting angle α (illustrated in FIG. 3) defines the inner surface of the vortex, in particular the vortex diameter V. The fluid injected by the first radial swirler device 101 and the second radial swirler device 102 flows with a first fluid pressure P1 in the direction to the combustion chamber 114. The second diameter 112 of the combustion chamber 114 increases abruptly with respect to the first diameter 111 of the pre-chamber 113. Thus, a pressure gradient between the first fluid pressure P1 and the second fluid pressure P2 with less pressure than P1 is generated, so that the fluid expands and is directed to the direction to the centre axis 106 of the tubular swirling chamber 120 as illustrated in FIG. 1. In the region of the centre axis 106 a re-circulation zone 110 is provided wherein the fluid is directed in a counter-direction to the first flow direction 107 and the second flow direction 108. With other words, the fluid flows back to the first radial swirler device 101 and the second radial swirler device 102 inside the re-circulation zone 110.

The re-circulation zone 110 is defined by a shear layer 109 that is formed by the inner surface of the vortex. The inner vortex diameter V is defined by the first flow direction 107 of the fluid streaming through the first radial swirler device 101 with a first injecting angle α. The fluid flowing through the re-circulation zone 110 flows in a counter-direction to the first flow direction 107 and the second flow direction 108 until the closed end (pilot body surface 103) of the pre-chamber 113 is reached. The area where the re-circulation zone 110 touches the pilot body surface 103 may be called flame anchor surface 104. In the region of the flame anchor surface 104, the fluid may be ignited and provide a permanently burning flame. The flame will extend from the flame anchor surface 104 in the direction to the combustion chamber 114.

When providing the fluid flow pattern as shown in FIG. 1, the vortex diameter V and thus the flame anchor surface 104 may be reduced compared to non dual swirler configurations. This is provided by a fluid injected by the first radial swirler device 101 with the first injection angle α (see first flow direction 107 of the fluid). Due to a reduced swirl numbers of the vortex when injecting the fluid more radially in a first flow direction 107 respectively with a first injecting angle α, a further fluid will be injected by the second radial swirler device 102 with the second injecting angle β that is more tangential. Thus, a vortex with a high swirl number is provided and at the same time a reduced diameter of the flame anchor surface 104 is generated. By the smaller flame anchor surface 104 less fluctuation of the centre re-circulation zone 110 with constant flow characteristics may be provided.

FIG. 2A and FIG. 2B illustrate a perspective view of the swirler arrangement 100 including a first radial swirler device 101 and a second radial swirler device 102. The first radial swirler device 101 comprises the first vanes 201 and the second radial swirler 102 device comprises the second vanes 202.

In FIG. 2A a view is directed to the second radial swirler device 102. The second vanes 202 may form an essentially triangular shape, wherein the second vanes 202 are distributed in a circumferential direction. The second vanes 202 form between each other ducts, in which the fluid may be guided into the inside of the second radial swirler device 102 in a predetermined direction, in particular with the second injecting angle β. In FIG. 2B the view is more directed to the first radial swirler device 101 wherein the first vanes 201 are distributed in a circumferential direction. Between the first vanes 201 ducts are formed through which the fluid may flow and injected into the inside of the first radial swirler device 101 with the first injecting angle α. The first vanes 201 may form an essentially triangular shape. The first radial swirler device 101 and the second radial swirler device 102 may inject the fluid along a plane that is perpendicular to the centre axis 106. The first vanes 201 and the second vanes 202 may also be attached to the first radial swirler device 101 or the second radial swirler device 102 in a movable manner, such as in a pivotable manner. By pivoting either the first vanes 201 or the second vanes 202 the first injecting angle α and the second injecting angle β may be adjusted. Thus, a desired first flow direction 107 or a second flow direction 108 may be provided, so that a desired predetermined flow pattern inside the tubular swirling chamber 120 may be achieved. The first vanes 201 and the second vanes 202 may be movable, in particular pivotable, for changing the first injecting angle α and the second injecting angle β. The motion of the first vanes 201 and the second vanes 202 may be controlled by a control unit. The control unit may be controlled manually or automatically based on a measured sensor value.

Furthermore, FIG. 2A and FIG. 2B illustrate injection holes 203 through which fuel may be injected inside the ducts between the vanes 201,202. From the radial outside a pressured air may be guided through the ducts formed by the first vanes 201 and/or the second vanes 202. In these ducts the injection holes 203 may inject fuel to the pressurized air flow, so that a premixed air/fuel mixture may be provided. This air/fuel mixture may be inhomogeneous. A homogeneous mixture of the air/fuel ratio may be provided by the internal flow in the internal circulation zone 105 and the re-circulation zone 110.

In FIGS. 2A and 2B the inner radial tips of the vanes 201 and 202 are in line. Possibly other configurations may also be advantageous in which the tips of the vanes 201 and 202 may be not aligned.

FIG. 3 illustrates a top view of the swirler arrangement 100. For a better illustration, the first radial swirler device 101 and the second radial swirler device 102 are illustrated in one and the same plane. As shown in FIG. 3, the first radial swirler device 101 comprising the first vanes 201 that injects the fluid with the first injecting angle α inside the tubular swirling chamber 120. The second radial swirler device 102 injects the fluid with the second injection angle β. The injecting angles α, β may be measured by an angle between the flow direction 107, 108 and a tangential direction along the inner surface 303 of the tubular swirling chamber 120 at the location where the fluid streams inside the tubular swirling chamber 120 respectively where the fluid streams over the inner surface 303 of the tubular swirling chamber 120. The first injecting angle α may be measured between the first flow direction 107 and the tangential direction of the inner surface 303 when the fluid enters the tubular swirling chamber 120. As can be seen from FIG. 3, the first flow direction 107 is directed more radial to the centre axis 106 as the second flow direction 108.

The fluid flowing through the second radial swirler device 102 may be injected with a second injecting angle β that may be measured between the second flow direction 108 and the tangential direction at the inner surface 303 of the tubular swirling chamber 120. As can be seen from FIG. 3, the second flow direction 108 of the fluid is more tangential than the first flow direction 107.

Figure 4:
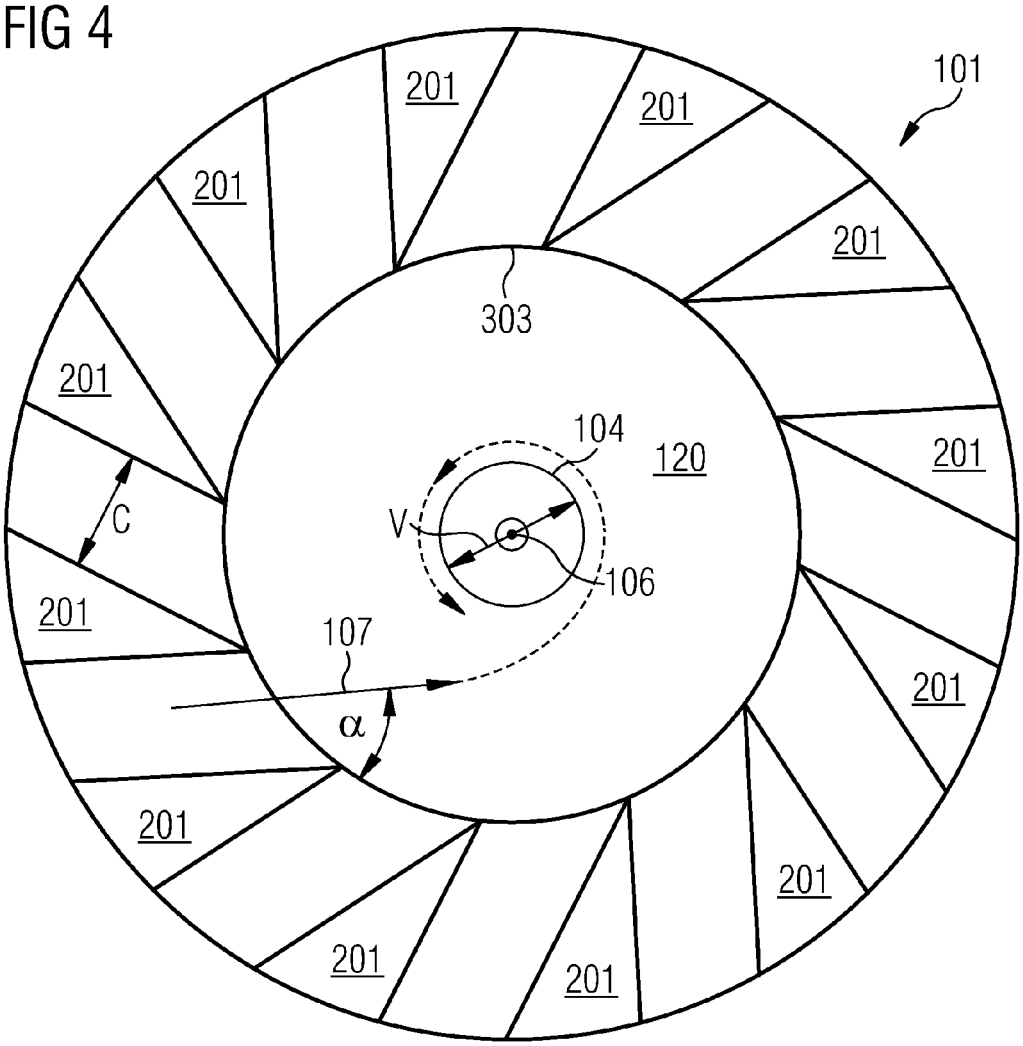
FIG. 4 illustrates a top view of a first radial swirler device according to an exemplary embodiment of the invention.

FIG. 4 illustrates a top view of the first radial swirler device 101. The triangular shaped first vanes 201 direct the fluid along the first flow direction 107 with a first injecting angle α inside the tubular swirling chamber 120. The fluid flowing along the first flow direction 107 begins to rotate in the vicinity of the centre axis 106 and thus provides the vortex with the vortex diameter V. Inside the vortex the flame anchor surface 104 may be defined. Moreover, FIG. 4 illustrates a certain width C of ducts formed by the first vanes 201, so that a certain mass flow of the fluid through the first radial swirler device 101 may be defined by the width C of the ducts.

Figure 5:
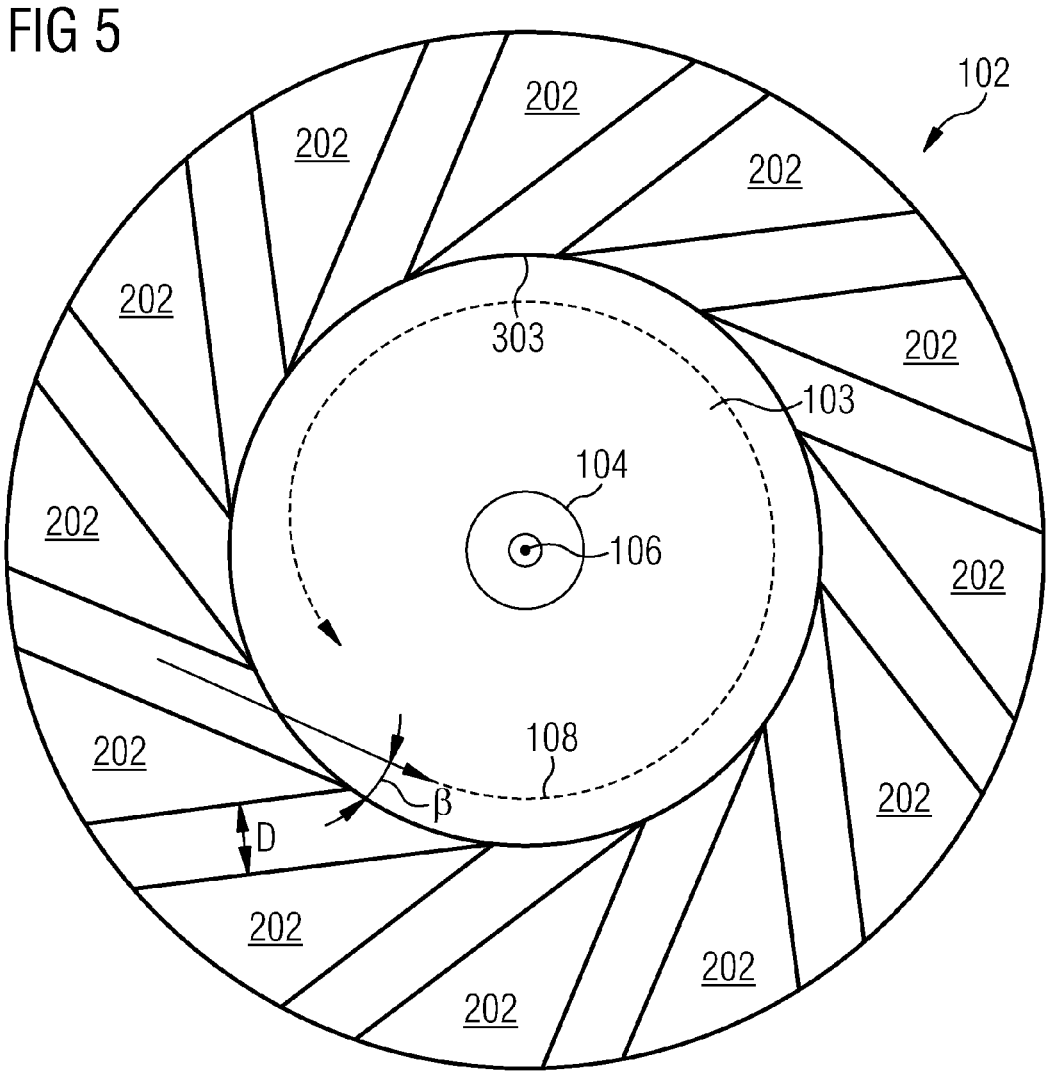
FIG. 5 shows a top view of a second radial swirler device according to an exemplary embodiment.

FIG. 5 shows a top view of the second radial swirler device 102. The second vanes 202 direct the fluid in a second flow direction 108 with a second injecting angle β inside the tubular swirling chamber 120. The fluid flowing through the second radial swirler device 102 is guided more tangentially along the inner surface 303 of the tubular swirling chamber 120. Thus, the inner surface 303 of the tubular swirling chamber 120 guides the fluid along the second flow direction 108 in a circumferential direction, so that the fluid, flowing through the second radial swirler device 102 forms the vortex inside the tubular swirling chamber 120. The rotation of the fluid along the second flow direction 108 may also effect and initiate the rotation of the fluid flowing through the first radial swirler device 101 along the first flow direction 107. The second vanes 202 define also ducts with a certain width D of the second vanes 202. By the width D of the second vanes, the mass flow of the fluid may be defined.

Figure 6:
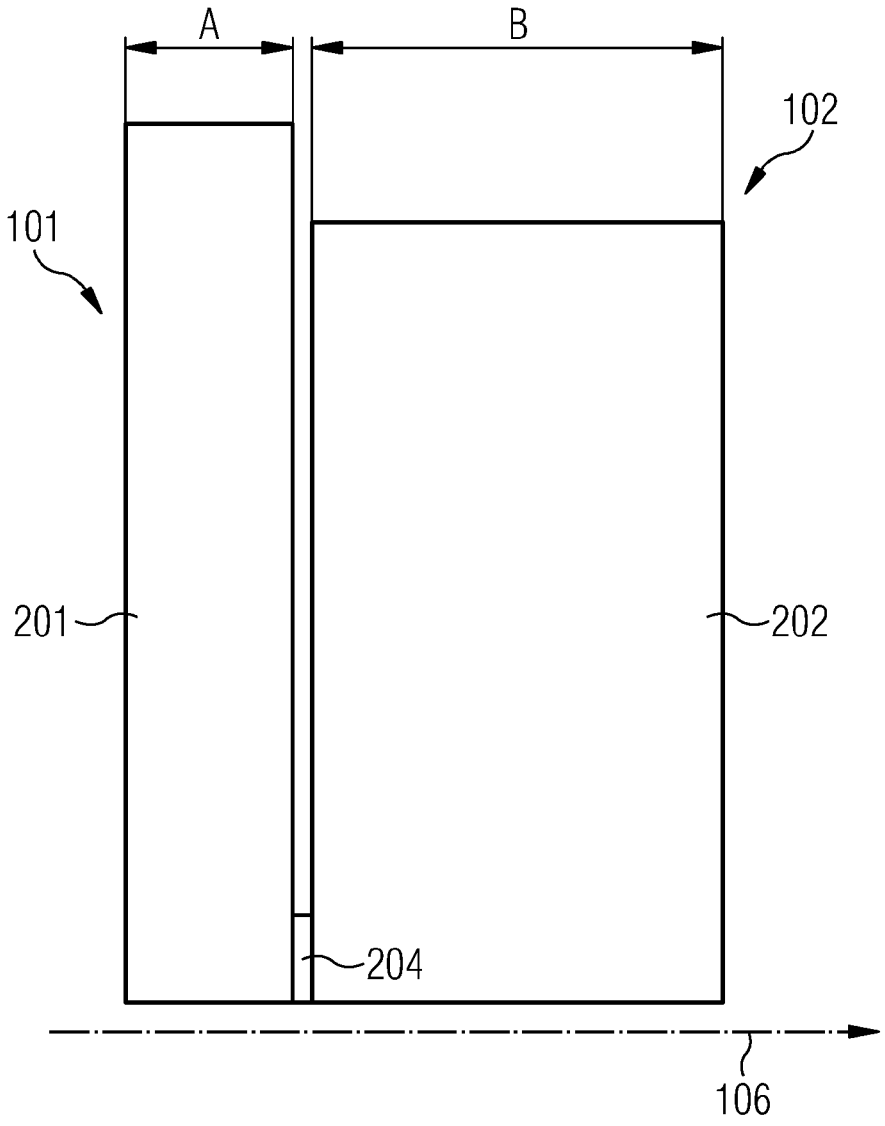
FIG. 6 shows a schematic view of a first and a second radial swirler device according to an exemplary embodiment.

FIG. 6 illustrates a side view of the first radial swirler device 101 and the second radial swirler device 102 stacked in a row. The first radial swirler device 101 and the second radial swirler device 102 may be separated by the adapter plate 204. The first radial swirler device 101, respectively the first vanes 201 may comprise a height A that may be different to a height B of the second vanes 202 of the second radial swirler device 102. Thus, a desired and predefined mass flow of the fluid through the first radial swirler device 101 and the second radial swirler device 102 may be defined.

Figure 7:
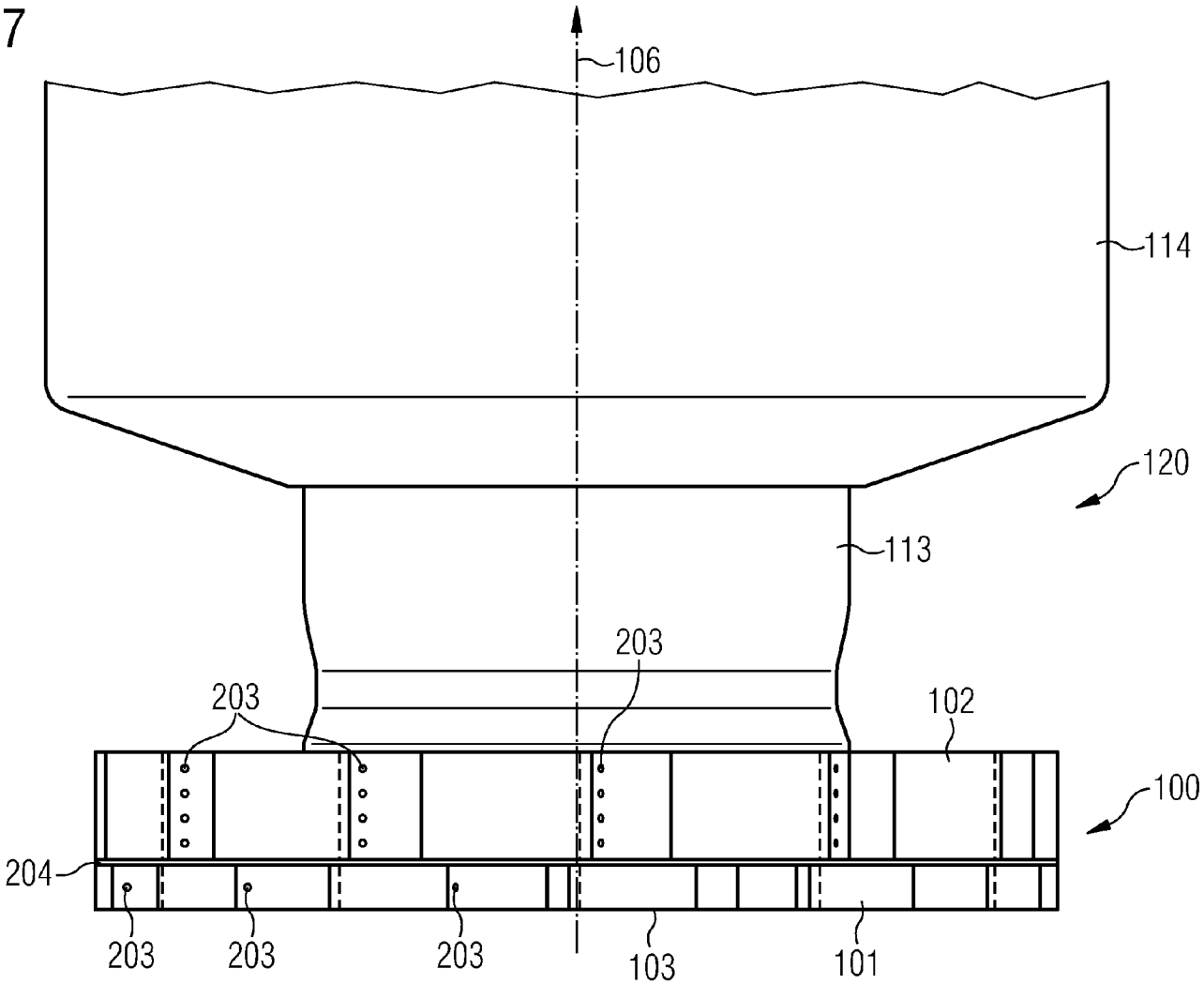
FIG. 7 shows a schematic view of a tubular swirling chamber with a swirler arrangement according to an exemplary embodiment of the invention.

FIG. 7 illustrates a perspective view of the tubular swirling chamber 120 from radial outside including the swirler arrangement 100. The tubular swirling chamber 120 comprises a tubular shape around the centre axis 106. In the area of the pilot body surface 103 the first radial swirler device 101 is attached. In a direction to combustion chamber 114, the second radial swirler device 102 is attached. The first radial swirler device 101 and the second radial swirler device 102 may be attached to the adapter plate 204 and are thus based in a defined manner. Each of the first radial swirler device 101 and the second radial swirler device 102 comprise the injection holes 203, through which the fuel may be injected.

Figure 8:
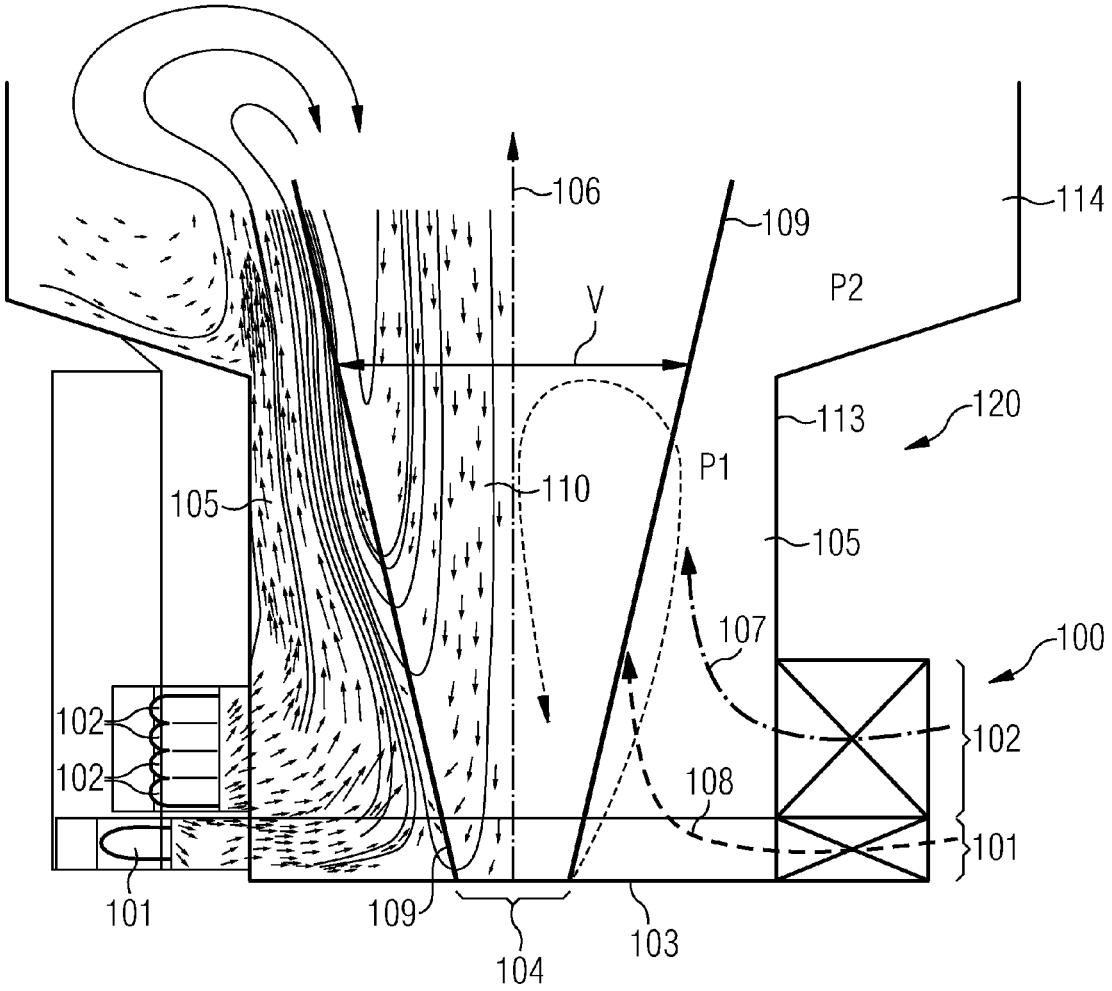
FIG. 8 illustrates an exemplary embodiment of FIG. 1 including a flow diagram of the fluid.

FIG. 8 illustrates a schematic view of the tubular swirling chamber 120, wherein also a flow diagram on the left side of the centre axis 106 is shown. The vector arrows show the direction of the fluid flow and the density of the vector arrows illustrates a velocity of the fluid flow. A high density of vector arrows illustrates a high fluid velocity.

At the bottom surface of the pre-chamber 113 the pilot body surface 103 closes the tubular shape of the pre-chamber 113. In the vicinity of the pilot body surface 103 the first radial swirler device 101 may be attached. The fluid is injected by the first radial swirler device 101 by the first injection angle α and thus injected more to the centre axis 106. Moreover, a plurality of second radial swirler devices 102 is shown which are fit together like a stack. As shown by the vector arrows, the fluid may be injected with a second injection angle β in a second flow direction, wherein the second flow direction is more tangentially in comparison to the fluid flow injected by the first radial swirler device 101.

For the following a pressure ratio PR is defined as $$PR = \frac{P1}{P2}.$$

Due to the pressure ratio PR of the fluid caused by the difference of the first diameter 111 of the pre-chamber 113 and the second diameter 112 of the combustion chamber 114, the fluid flow in the internal circulation zone 105 expands abruptly in the region of the combustion chamber 114, so that a re-circulation zone 110 is provided in which the fluid flows back to the pilot body surface 103. The diameter of the re-circulation zone 110 is similar to the vortex diameter V around which the fluid swirls in the internal circulation zone 105. Between the internal circulation zone 105 and the re-circulation zone 110 a shear layer 109 is provided. The vortex diameter V respectively the diameter of the shear layer 109 provides a flame anchor surface 104 on the pilot body surface 103. As shown by the low density of the vector arrows in the region of the re-circulation zone 110 and in particular in the vicinity of the flame anchor surface 104, the velocity of the fluid is slower than the velocity of the fluid in the internal circulation zone 105. Thus, the fluid that flows in the vicinity of the flame anchor surface remains longer in the region of the flame anchor surface 104, so that a better combustion of the fluid may be provided. Moreover, it is shown that the second flow direction 108, in particular the fluid that is injected by the first injection angle α from the first radial swirler device 101 pushes the shear layer 109 more to the centre axis 106, so that the diameter of the flame anchor surface 104 may be reduced. At the same time, the fluid flowing with the second flow direction and injected by the second injection angle β by the second radial swirler device 102 provides a vortex respectively a fluid flow with a high velocity (high density of the vector arrows), so that a stable and efficient fluid flow may be established. The shape of the fluid flow pattern may be formed literally a shape of a mushroom.

Figure 9A:
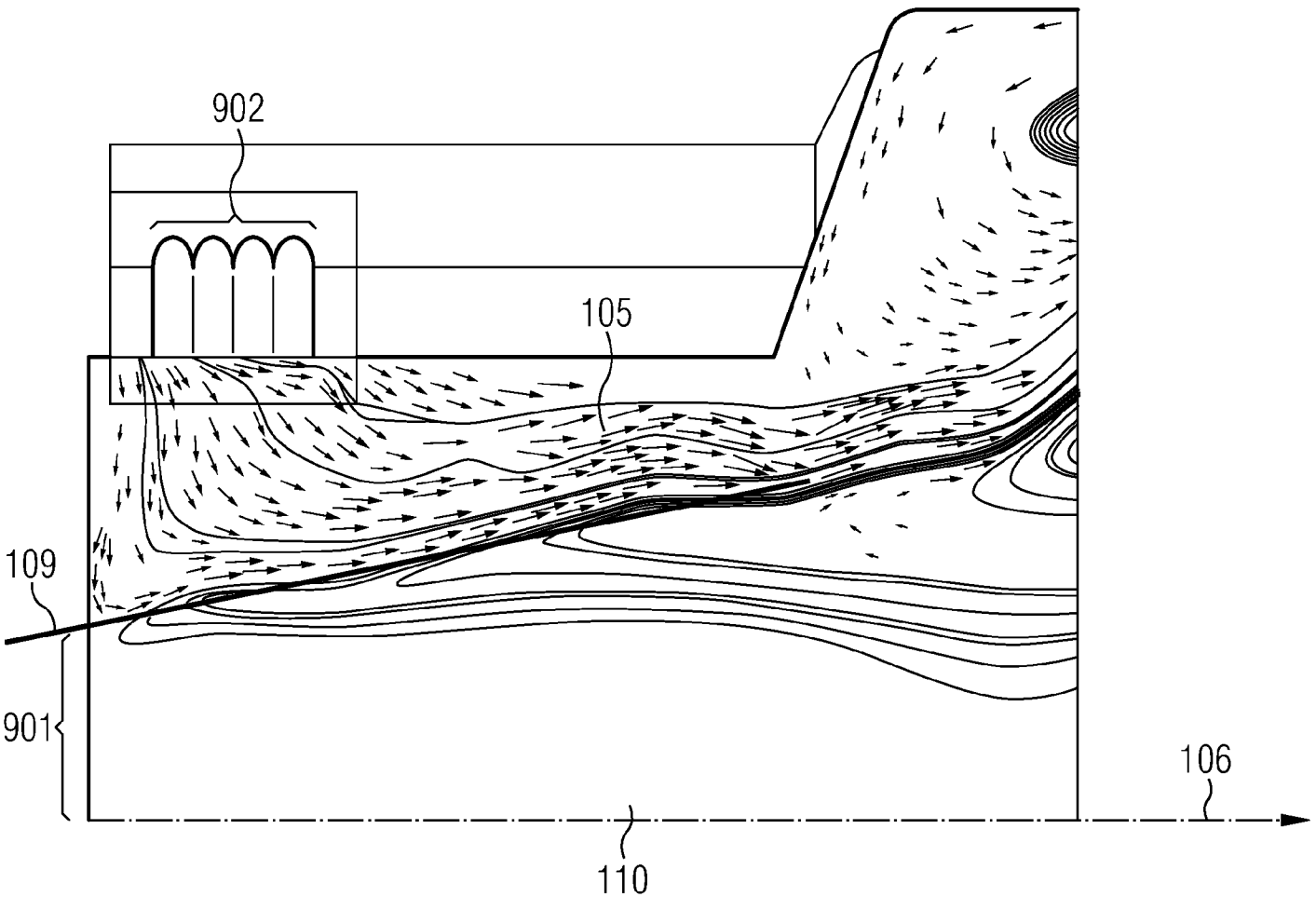
FIG. 9A shows a flow diagram of a fluid inside a tubular swirling chamber by use of a conventional radial swirler device.
Figure 9B:
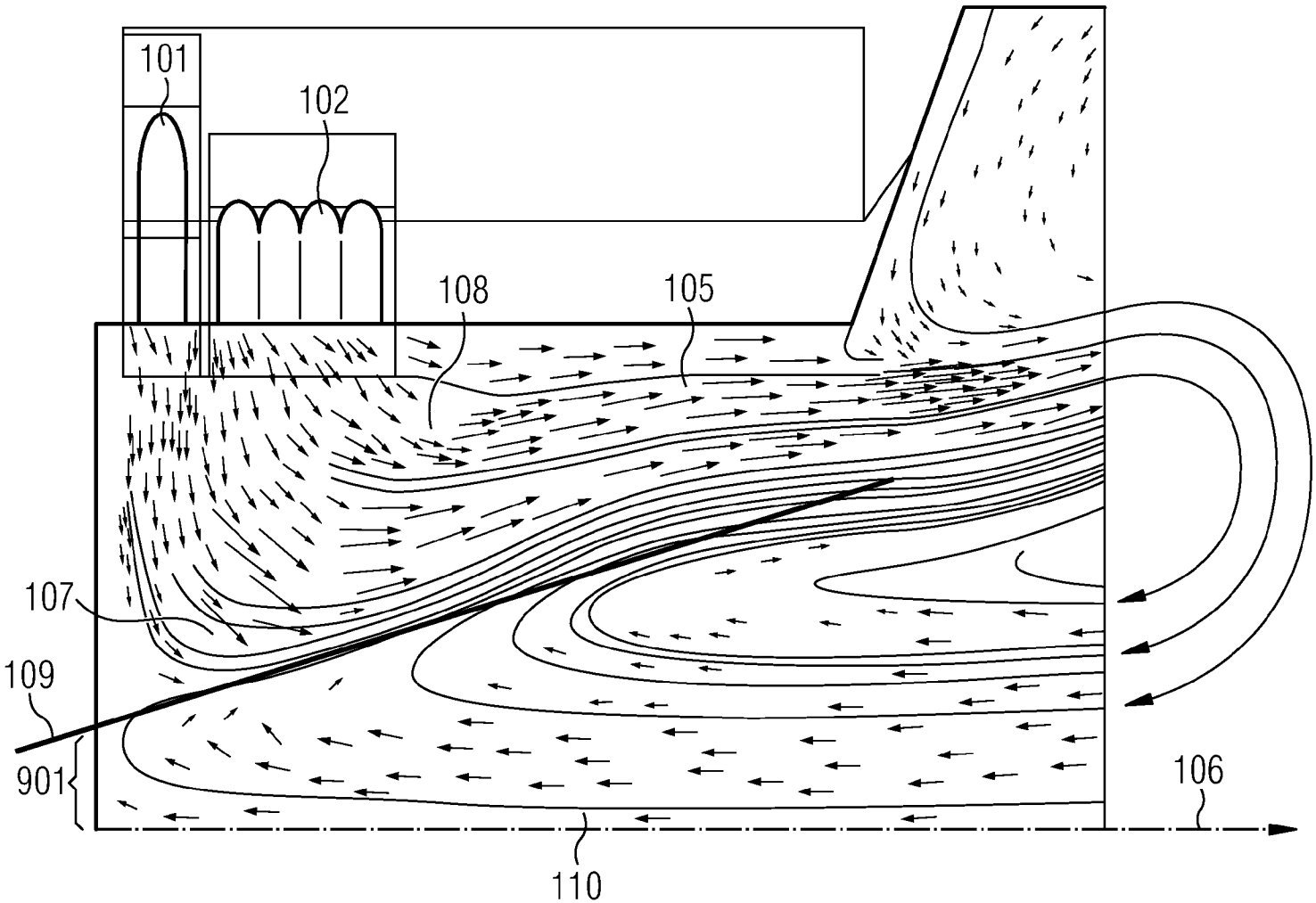
FIG. 9B shows a flow diagram of a fluid inside a tubular swirling chamber according to an exemplary embodiment of the present invention.

FIG. 9A illustrates a flow pattern of a conventional swirler device whereas FIG. 9B illustrates a flow pattern of the claimed swirler arrangement 100 according to an exemplary embodiment. In FIG. 9A it is shown that only one conventional swirler 902 injects the fluid with one constant injecting angle. Thus, the fluid flows along the internal circulation zone 105 and flows in a counter-direction in the re-circulation zone 110 to the conventional flame anchor surface 901. In order to keep the flame stable and in order to provide a vortex flow of the fluid in the internal circulation zone 105, the fluid has to be injected by the conventional swirler device 902 in a tangential direction, respectively with a very small injecting angle (tangential direction=injection angle 0°). Thus, the shear layer 109 is located more away from the centre axis 106 and thus provides a larger diameter. Thus, the conventional flame anchor surface 901 is very large.

In FIG. 9B it is shown that by the first radial swirler device 101 the fluid is injected with a first injecting angle α, so that the fluid flow 107 is directed more radially to the centre axis 106. Thus, the shear layer 109 is literally pushed to the centre axis 106, so that the diameter of the flame anchor surface 104 may be reduced. In order to provide a stable circulation and a stable vortex in the internal circulation zone 105 and in order to provide a counterflow of the fluid in the re-circulation zone 110, the second radial swirler device 102 injects the fluid in a more tangential direction, respectively by the second injection angle, so that the fluid flows along the second flow direction 108. Thus, a stable flow pattern may be provided and at the same time a stable combustion of the fluid and a reduced flame anchor surface 104 may be provided.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A swirler arrangement for injecting a fluid into a tubular swirling chamber having an inner surface, the swirler arrangement comprising:

a first radial swirler device;

a second radial swirler device; and an adapter plate, wherein the swirler arrangement is fixed around an internal circulation zone of the tubular swirling chamber, wherein the first radial swirler device includes a plurality of first vanes, the plurality of first vanes are formed to inject the fluid into the internal circulation zone with a first injecting angle, wherein the second radial swirler device includes a plurality of second vanes, the plurality of second vanes are formed to inject the fluid into the internal circulation zone with a second injecting angle, wherein the first injecting angle and the second injecting angle are defined by an angle between an injecting direction of the fluid and a tangential direction along the inner surface, wherein the first injecting angle and the second injecting angle are smaller than 90°, wherein the first injecting angle and the second infecting angle are different, wherein the first radial swirler device and the second radial swirler device are attached to the adapter plate, and wherein the adapter plate includes a defined thickness for spacing the first radial swirler device and the second radial swirler device, wherein the adapter plate is formed by a circumferential plate with a through-hole, and wherein the through-hole is adapted to a diameter of the tubular combustion chamber.

2. The swirler arrangement as claimed in claim 1, wherein the first radial swirler device is located closer to a pilot body surface of the tubular swirling chamber than the second radial swirler device, and wherein the second injecting angle is smaller than the first injecting angle.

3. The swirler arrangement as claimed in claim 1, wherein at least one of the first radial swirler device and the second radial swirler device include a plurality of injection holes.

4. The swirler arrangement as claimed in claim 3, further comprising a control unit, wherein the control unit is adapted for controlling the first injecting angle and/or the second injecting angle by moving the plurality of first vanes and/or the plurality of second vanes.

5. The swirler arrangement as claimed in claim 1, wherein at least one of the plurality of first vanes and the plurality of second vanes are movable, so that at least a desired first injecting angle and/or second injecting angle are adjustable.

6. The swirler arrangement as claimed in claim 1, wherein a first width of a duct between adjacent vanes of the plurality of first vanes and a second width of a duct between adjacent vanes of the plurality of second vanes are different.

7. The swirler arrangement as claimed in claim 1, wherein a first height of the plurality of first vanes and a second height of the plurality of second vanes are different.

8. The swirler arrangement as claimed in claim 1, further comprising a plurality of first radial swirler devices and/or a plurality of second radial swirler devices.

9. A method of injecting a fluid into a tubular swirling chamber by a swirler arrangement fixed around an internal circulation zone of the tubular swirling chamber, the method comprising:

injecting the fluid into the internal circulation zone with a first injecting angle by a plurality of first vanes of a first radial swirler device of the swirler arrangement; and injecting the fluid into the internal circulation zone with a second injecting angle by a plurality of second vanes of a second radial swirler device of the swirler arrangement, wherein the first injecting angle and the second injecting angle are defined by an angle between an injecting direction of the fluid and a tangential direction along an inner surface, wherein the first injecting angle and the second injecting angle are smaller than 90°, and wherein the first injecting angle and the second injecting angle are different, wherein the swirler arrangement further comprises an adapter plate, wherein the first radial swirler device and the second radial swirler device are attached to the adapter plate, wherein the adapter plate includes a defined thickness for spacing the first radial swirler device and the second radial swirler device, wherein the adapter plate is formed by a circumferential plate with a through-hole, wherein the through-hole is adapted to a diameter of the tubular combustion chamber.

10. The method as claimed in claim 9, wherein the first radial swirler device is located closer to a pilot body surface of the tubular swirling chamber than the second radial swirler device, and wherein the second injecting angle is smaller than the first injecting angle.

11. The method as claimed in claim 9, wherein at least one of the first radial swirler device and the second radial swirler device include a plurality of injection holes.

12. The method as claimed in claim 9, wherein at least one of the plurality of first vanes and the plurality of second vanes are movable, so that at least a desired first injecting angle and/or second injecting angle are adjustable.

13. The method as claimed in claim 12, further comprising a control unit, wherein the control unit is adapted for controlling the first injecting angle and/or the second injecting angle by moving the plurality of first vanes and/or the plurality of second vanes.

14. The method as claimed in claim 9, wherein a first width of a duct between adjacent vanes of the plurality of first vanes and a second width of a duct between adjacent vanes of the plurality of second vanes are different.

15. A swirler arrangement for injecting a fluid into a tubular swirling chamber having an inner surface, the swirler arrangement comprising:

a first radial swirler device; and a second radial swirler device;

wherein the swirler arrangement is fixed around an internal circulation zone of the tubular swirling chamber, wherein the first radial swirler device includes a plurality of first vanes, the plurality of first vanes are formed to inject the fluid into the internal circulation zone with a first injecting angle, wherein the second radial swirler device includes a plurality of second vanes, the plurality of second vanes are formed to inject the fluid into the internal circulation zone with a second injecting angle, wherein the first injecting angle and the second injecting angle are defined by an angle between an injecting direction of the fluid and a tangential direction along the inner surface, wherein the first injecting angle and the second injecting angle are smaller than 90°, and wherein the first injecting angle and the second injecting angle are different, wherein at least one of the plurality of first vanes and the plurality of second vanes are movable, so that at least a desired first injecting angle and/or second injecting angle are adjustable, and further comprising a control unit, wherein the control unit is adapted for controlling the first injecting angle and/or the second injecting angle by moving the plurality of first vanes and/or the plurality of second vanes.

* * * * *